United States Patent [19]

Clendinen

[11] Patent Number: 4,577,376

[45] Date of Patent: Mar. 25, 1986

[54] SNAP FASTENER

[76] Inventor: Charles D. Clendinen, 152 Lodewyck, Mount Clemens, Mich. 48043

[21] Appl. No.: 522,056

[22] Filed: Aug. 10, 1983

Related U.S. Application Data

[63] Continuation-in-part of Ser. No. 340,204, Jan. 1, 1982, Pat. No. 4,409,706, which is a continuation-in-part of Ser. No. 255,370, Apr. 20, 1981, abandoned, and a continuation-in-part of Ser. No. 340,203, Jan. 18, 1982.

[51] Int. Cl.[4] ..... A44B 17/00

[52] U.S. Cl. ..... 24/624; 24/662; 24/663

[58] Field of Search ..... 24/624, 662, 618, 621, 24/623, 689, 692, 695, 588, 460, 461, 462

[56] References Cited

U.S. PATENT DOCUMENTS

| | | | |
|---|---|---|---|
| Re. 14,581 | 12/1918 | McMeekin . | |
| 506,110 | 10/1893 | Hampel . | |
| 681,086 | 8/1901 | Washburne | 24/624 |
| 717,333 | 12/1902 | Brigham | 24/662 |
| 991,156 | 5/1911 | Kerngood . | |
| 1,096,897 | 5/1914 | Fisher | 24/662 |
| 1,204,173 | 11/1916 | McMeekin . | |
| 1,302,918 | 5/1919 | Harris | 24/662 |
| 1,748,047 | 2/1930 | Carr | 24/623 |
| 2,099,979 | 11/1937 | Bangs | 24/662 |
| 2,397,801 | 4/1946 | Mitchell . | |
| 2,709,290 | 5/1955 | Rosenthal | 24/618 |
| 2,895,199 | 7/1959 | Jones . | |
| 2,941,270 | 6/1960 | Long . | |
| 2,980,975 | 4/1961 | Jones . | |
| 2,986,790 | 6/1961 | Silver . | |
| 3,107,409 | 10/1963 | Arthaud et al. | 24/662 |
| 3,210,820 | 10/1965 | Humiston . | |
| 3,213,507 | 10/1965 | Christian et al. . | |
| 3,328,854 | 7/1967 | Tombari . | |
| 3,349,451 | 10/1967 | Maeno . | |
| 3,416,200 | 12/1968 | Daddona . | |
| 3,729,780 | 5/1973 | White . | |
| 3,786,982 | 1/1974 | Rakes et al. . | |
| 4,305,171 | 12/1981 | Pettersson . | |

FOREIGN PATENT DOCUMENTS

| | | |
|---|---|---|
| 91282 | 2/1923 | Austria . |
| 98040 | 6/1898 | Fed. Rep. of Germany . |
| 872204 | 6/1942 | France . |

OTHER PUBLICATIONS

DOT ® Brochure, three sheets, no date is given.

*Primary Examiner*—Victor N. Sakran
*Attorney, Agent, or Firm*—Burton, Parker & Schramm

[57] ABSTRACT

A low profile snap fastener comprising a telescoping stud and receiver has latching and locking diameters measured across the stud which are so related to the internal diameter of the receiver that the stud and receiver can only be telescoped to and from a locked position by a predetermined relative motion between them.

5 Claims, 6 Drawing Figures

SNAP FASTENER

RELATED U.S. APPLICATION DATA

This application is a continuation-in-part of U.S. application Ser. No. 340,204 filed Jan. 1, 1982 and issued as U.S. Pat. No. 4,409,706 Oct. 18, 1983, which is incorporated by reference herein, which was a continuation-in-part of Ser. No. 255,370 filed Apr. 20, 1981, now abandoned, and Ser. No. 340,203 filed Jan. 18, 1982.

FIELD OF INVENTION

This invention relates to a snap fastener intended to temporarily connect together a pair of members with which the fastener is associated.

BACKGROUND OF THE INVENTION

There has been a long-felt need for a fastener which overcomes some of the problems associated with the snap button fastener, such as the DOT ® fastener found in service on boat covers and many other canvas and the like articles. Some of the problems associated with the conventional DOT ® type fastener are:

(a) There is a critical tolerance requirement that makes snap buttons unpredictable as to holding strength. Since snap buttons operate by the critical mating of two dimensions, they are subject to great variation in holding strength because of variations in dimensions or tolerances in the spring ring and male stud parts. Because most snap button fasteners are sheet brass made on progressive dies, they are soft enough to be deformed during usage and this can render them inoperable or change their holding characteristics, making them either too loose or too tight.

(b) Weathering of the parts of snap button fasteners can make the buttons too tight to pull apart, especially in hostile environments like salt water, industrial pollution and the like.

(c) Limited strength due to manufacture from sheet brass or molded plastic construction renders the conventional snap button fastener of limited utility when confronting heavy loads.

(d) There is considerable difficulty in operating such a fastener when either the male or female side of the fastener is covered with foreign matter such as dust, mud, ice, grease, etc.

In the prior art the following patents depict fastening devices in which a stud and/or eyelet must be deformed as a necessary condition precedent to latching or locking the stud and eyelet together: U.S. Pat. Nos. 991,156; 2,397,801; 2,986,790; 3,213,507; 3,349,451; 3,416,200; 3,729,780 and 2,786,982.

SUMMARY OF THE INVENTION

I have discovered that a low profile snap fastener may be provided in which the receiver member which is telescoped over the stud may lie in a position parallel to the member upon which the stud is mounted, or, in other words, perpendicular to the axis of the stud, rather than being askew thereof as in the case of the fasteners shown in the aforesaid related applications. In carrying out the invention, the stud is provided with receiver seats on opposite sides thereof with a latching shoulder on the stud above one of the seats and a retaining lobe on the stud above the other seat. The receiver has an internal diameter allowing it to be telescoped over the stud for nesting in the seats. The internal diameter of the receiver is sufficiently less than the diameter of the stud as measured from the apex of the aforesaid lobe to the seat on the opposite side of the stud, that the receiver cannot bypass the lobe when it is nested in such seat at the opposite side of the stud. At the same time, the internal diameter of the receiver is slightly less than the diameter of the stud as measured from the apex of the latching shoulder to the seat on the opposite side of the stud by an interference amount in which the stud and/or receiver may be deformed within the elastic limit to allow the receiver to snap past the latching shoulder while nested in such seat at the opposite side of the stud.

Other features and advantages will become apparent during the following description.

DETAILED DESCRIPTION OF PREFERRED EMBODIMENT

Figure 3:
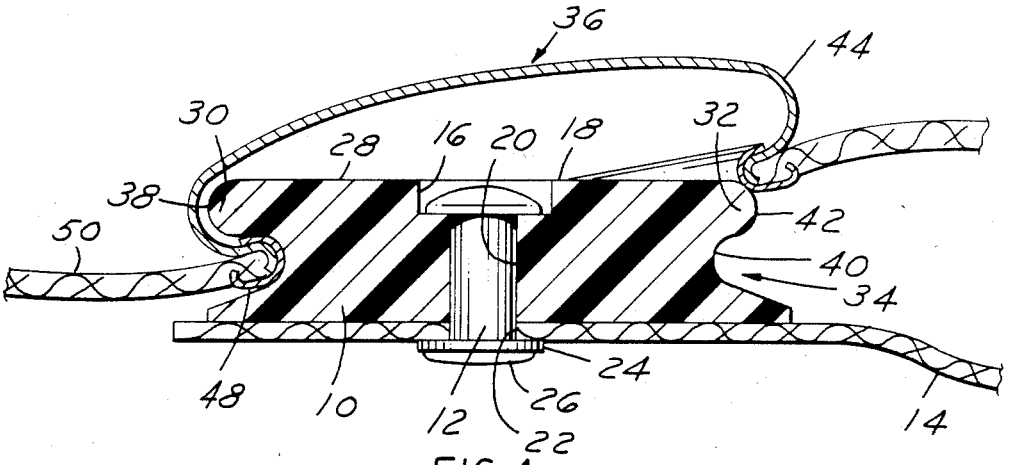
FIG. 3 shows the receiver nested in the receiver seat beneath the retaining lobe and about to be snapped past the latching shoulder.

In FIG. 3 I have shown a stud 10 of generally cylindrical configuration and a relatively low profile secured as by a rivet 12 to a part or member to be secured by the fastener, such as a fabric or the like 14. The head of the rivet is received in a counterbore 16 in the upper end 18 of the stud and extends through a bore 20, through a provided aperture 22 in the fabric 14, through a washer or the like 24 and is headed as at 26 below the washer. The stud may also be secured to the fabric 14 in any other suitable fashion and the arrangement shown is merely intended to show a means of securement.

The stud 10 may be formed of plastic or may be a cold headed part or may be formed on a progressive die. The stud includes a head portion 28 which in the embodiment shown is concentric with the bore 20 and is of uniform cross-section circumferentially of the stud. The head 28 defines what may be referred to as a retaining lobe 30 and a latching shoulder 32 which are on opposite sides of the stud and in this embodiment are simply portions of the uniform head portion 28. The retaining lobe and latching shoulder in some embodiments may be of different configurations to suit the latching action desired.

Figure 2:
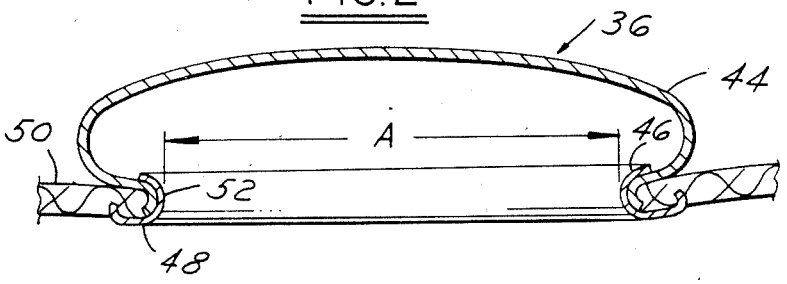
FIG. 2 is a cross-sectional view through a receiver usable with the stud.
Figure 4:
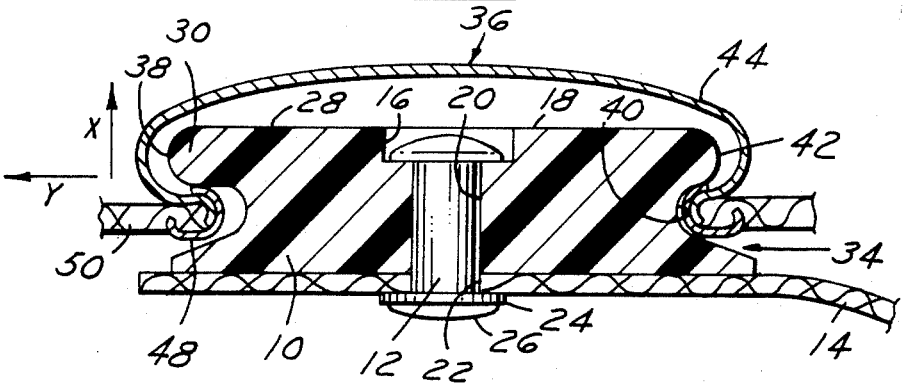
FIG. 4 shows the receiver in latched position on the stud.
Figure 5:
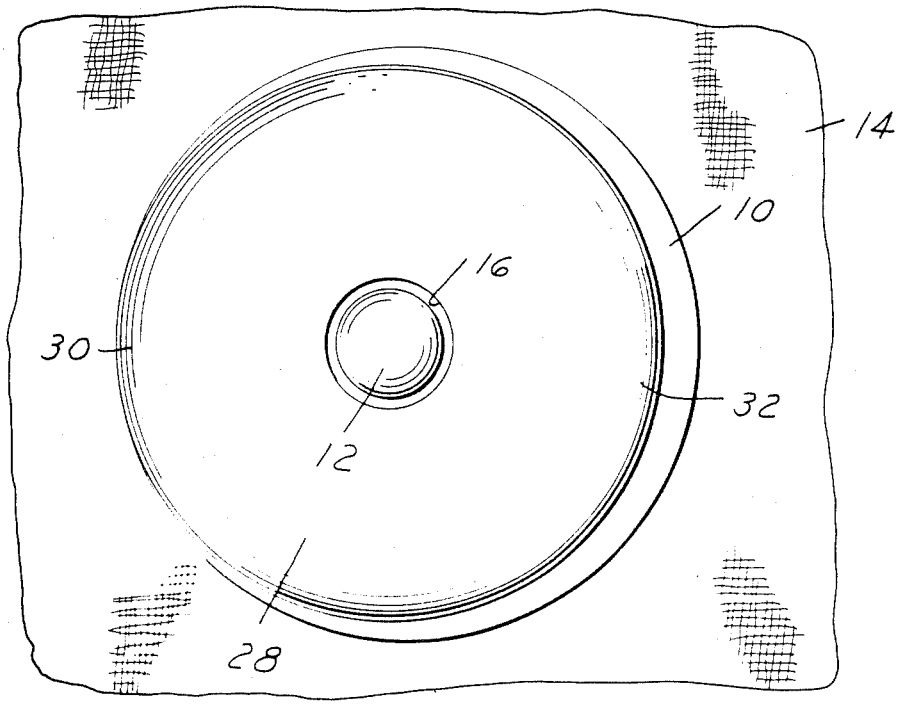
FIG. 5 shows the stud secured to a section of fabric.
Figure 6:
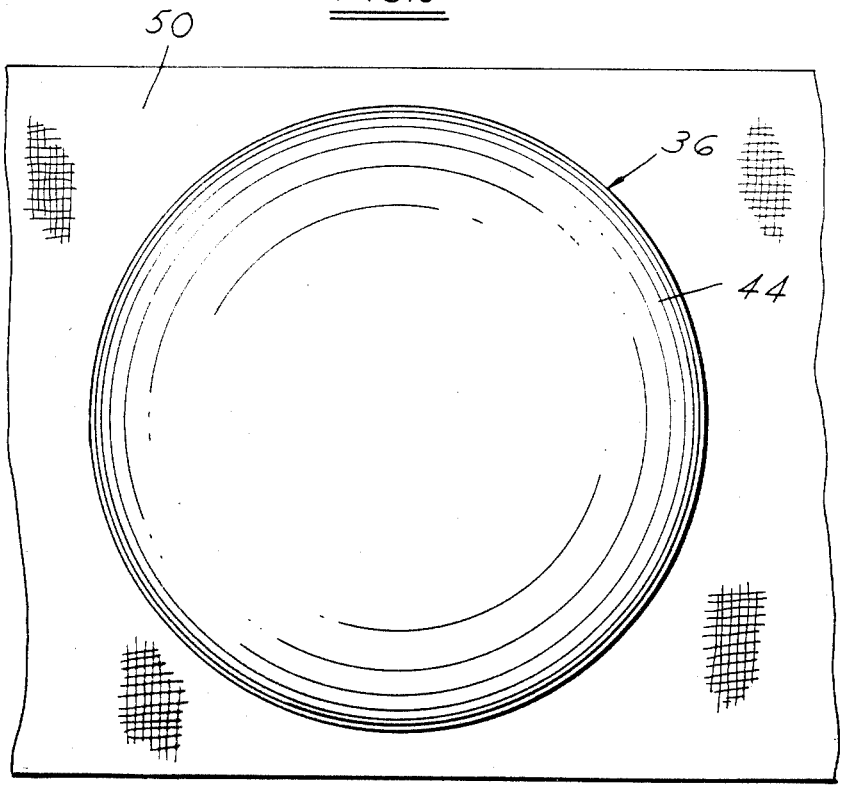
FIG. 6 shows the receiver secured to a section of fabric.

Beneath the head portion 28 there is a circumferential groove 34 which provides a receiver seat immediately below each of the lobe and latching shoulder so that the receiver 36 shown in FIG. 2 may be nested in such groove as hereinafter explained and as shown in FIG. 4.

Figure 1:
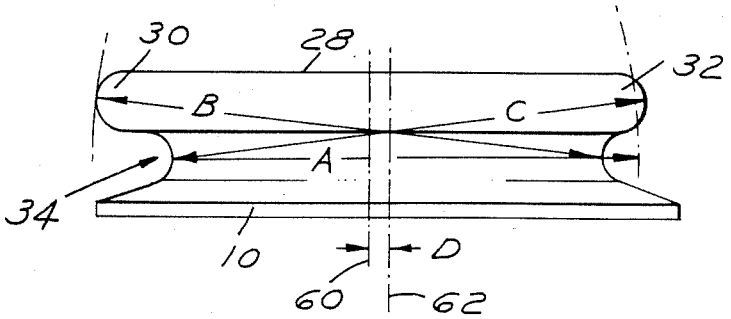
FIG. 1 is a side elevation of a stud illustrating certain critical relationships in the configuration thereof.

The stud lobe 30 has an apex 38 between which and the bottom 40 of groove 34 on the opposite side of the stud defines a diameter B shown in FIG. 1, which may be referred to as the "locking diameter". The latching shoulder had an apex 42 between which and the bottom 40 of groove 34 at the opposite side of the stud, defines what may be referred to as a "latching diameter" shown in FIG. 1 at C.

The receiver 36 may take various forms. In the drawings the receiver is a cylindrical hat-shaped button having a dome portion 44 which has been crimped within a separate rim portion 46, both the dome and rim portions having been crimped around the marginal edge 48 of an aperture in a fabric member 50 in which the receiver or button is mounted. Except for the dome portion 44, the receiver is much like the eyelet shown in the companion applications. If desired, the dome portion 44 may be omitted and an eyelet configuration utilized. Where, however, it is desirable to conceal and cover the stud when the receiver is latched or locked thereto, the dome type receiver shown in FIGS. 2–4 may be used.

The receiver may be formed of metal or plastic, using well known techniques. It is crimped into the fabric 50 in any suitable fashion. The receiver has an internal circular aperture 52 defined by the rim 46. There is an internal diameter A for such aperture as shown in FIG. 2. In FIG. 1 the diameter A of the receiver is shown superimposed upon the stud. From FIG. 1 it will be noted that dimension A measured from the bottom of the groove 34 beneath the locking lobe 30 is slightly less than dimension C. The difference in dimensions A and C provides an interference fit between the receiver and stud wherein either the receiver or stud or both may deform within the elastic limits of such parts to allow the receiver to pass from the position shown in FIG. 4 to that shown in FIG. 4 wherein the internal rim 46 of the receiver will snap past the apex 42 of the latching shoulder 32 to be seated in the groove or receiver seat 34 there beneath.

Dimension B shown in FIG. 1 and referred to as the "locking diameter" is greater than the receiver diameter A by an amount preventing the receiver from being removed over the lobe 30 when the receiver is seated at its opposite side in the receiver seat beneath the latching shoulder 32. In other words, when the receiver is mounted on the stud as shown in FIG. 4, the receiver cannot be forced, without destruction, off the stud by pulling the fabric 50 in the directions of either X or Y as shown in FIG. 4.

As shown in FIG. 1, the head portion 28 is formed on the axis 60. The groove 34 defining the receiver seats is formed on the axis 62 which is displaced from the axis 60 by the dimension D. Such displacement of the respective axes gives rise to the locking and latching diameters B and C respectively and enables securement of the receiver on the stud. In the embodiment shown, the axes 60 and 62 are parallel and their displacement D is substantially equal to the difference in the locking and latching dimensions B and C respectively.

I claim:

1. A snap fastener comprising, in combination:

a stud intended to upstand at one end from a member to be fastened;

receiver seats disposed on opposite sides of the stud;

a latching shoulder on the stud above one of the seats;

a retaining lobe on the stud above the other seat;

said stud, including the latching shoulder and retaining lobe having a continuous peripheral surface;

a receiver intended to association with a member to be fastened to the first mentioned member and having an aperture with a continuous internal surface dimensioned to allow telescoping over the stud for nesting in said seats;

said internal dimension of the receiver being sufficiently less than the dimension of the stud, measured from the apex of said shoulder to the seat on the opposite side of the stud, to provide an interference fit permitting the receiver to pass the shoulder while nested in such seat at the opposite side of the stud and upon the elastic deformation of the stud and/or receiver; and wherein the stud head extends circumaxially around the stud at a substantially uniform distance from a first axis, and said receiver seats comprise portions of a groove at opposite sides of the stud which groove extends circumaxially around the stud at a substantially uniform distance from a second axis, and said axes are laterally displaced from each other.

2. The invention defined by claim 1 wherein said axes are parallel.

3. The invention defined by claim 2 wherein the said dimensions of the stud measured from the apex of said lobe and shoulder to the opposite seats differ by an amount substantially equal to the displacement of said axes.

4. A stud for a snap fastener comprising a generally cylindrical member having a head at one end and intended to be mounted in upstanding relation at its opposite end on a member to be fastened;

receiver seats disposed on opposite sides of the stud beneath said head;

a latching shoulder on the head above one of the seats;

a retaining lobe on the head above the opposite seat;

said stud, including the latching shoulder and retaining lobe having a continuous peripheral surface;

the dimension of the stud measured from the apex of said lobe to the seat on the opposite side of the stud being greater than the dimension of the stud measured from the apex of said shoulder to the seat on the other side of the stud to lock a receiver in said seats beneath the head; and wherein said head extends circumaxially around the stud and is substantially uniform with respect to a first axis, and said receiver seats comprise portions of a groove at opposite sides of the stud, which groove extends circumaxially around the stud and is substantially uniform with respect to a second axis, and said first and second axes are laterally displaced from each other.

5. The invention defined by claim 4 wherein the amount of displacement between said axes is substantially equal to the difference between said dimensions.

* * * * *